US006110414A

United States Patent [19]

Gohres et al.

[11] Patent Number: 6,110,414

[45] Date of Patent: Aug. 29, 2000

[54] VESSEL FOR METALLURGICAL PURPOSES

[75] Inventors: Hans-Werner Gohres, Duisburg; Franz-Josef Divjak, Rheinberg; Detlef Kristinat, Duisburg, all of Germany

[73] Assignee: Mannesmann AG, Düsseldorf, Germany

[21] Appl. No.: 09/355,715

[22] PCT Filed: Jan. 29, 1998

[86] PCT No.: PCT/DE98/00322

§ 371 Date: Aug. 3, 1999

§ 102(e) Date: Aug. 3, 1999

[87] PCT Pub. No.: WO98/34745

PCT Pub. Date: Aug. 13, 1998

[30] Foreign Application Priority Data

Feb. 6, 1997 [DE] Germany ..... 197 06 056

[51] Int. Cl.[7] ..... C21C 5/50

[52] U.S. Cl. ..... 266/246; 266/275; 266/280

[58] Field of Search ..... 266/245, 246, 266/274, 275, 280

[56] References Cited

U.S. PATENT DOCUMENTS

| | | | |
|---|---|---|---|
| 909,655 | 1/1909 | Palmer | 266/275 |
| 1,861,946 | 6/1932 | Wilhelmi | 266/275 |
| 2,165,066 | 7/1939 | Needham et al. | 266/245 |

*Primary Examiner*—Scott Kastler
*Attorney, Agent, or Firm*—Cohen, Pontani, Lieberman & Pavane

[57] ABSTRACT

A vessel for metallurgical purposes, for transporting molten metals, having a metal casing which accommodates a refractory lining, is composed of individual tubular lengths. Two reinforcement rings which run in the circumferential direction and are integrated in the metal casing at an axial distance from one another, and on which two bearing lugs are arranged opposite one another on the outside and are supported by in each case one plate which is connected to the reinforcement rings. If appropriate a lid attachment is fastened to the vessel edge, which lid attachment is frustoconical in cross section. The first reinforcement ring, which lies closer to the base, has an upwardly directed extension, which is designed in the form of a projection, in the area of the plate, which is designed as a shield segment. The, and the second reinforcement ring, which lies further away from the base, has a downwardly directed extension, which is designed in the form of a projection, in the area of the shield segment. The shield segment is welded in between the extensions. The transition from the respective extension into the respective reinforcement ring is rounded both in longitudinal section and in plan view, and the latter rounded sections merging smoothly into corresponding rounded sections of the shield segment.

8 Claims, 5 Drawing Sheets

SECTION B-B

VESSEL FOR METALLURGICAL PURPOSES

BACKGROUND OF THE INVENTION

The invention relates to a vessel for metallurgical purposes, for transporting molten metals.

DISCUSSION OF THE PRIOR ART

Vessels of this nature are used not only to transport molten metals, such as for example pig iron, from the blast furnace to the pig iron mixer or from the pig iron mixer to the converter, but may also be a metallurgical treatment vessel. In particular, as the demands imposed on the level of purity increase and the levels of dissolved gases are reduced, vacuum treatment has become increasingly important. In this method, the thermal load on the treatment vessel is particularly high, since the process involves a high overheating temperature.

To solve this problem, a vessel for metallurgical purposes has been proposed (DE 195 38 530 C1) in which, in contrast to the conventional design, the reinforcement rings are not welded onto the outside of the circumferential surface, but rather are integrated in the metal casing. Furthermore, the plate which supports the vessel bearing lugs is at a short distance from the metal casing, the upper and lower peripheral areas, which are of rim-like design, of the plate are connected to the adjoining reinforcement rings. The vessel bearing lug which is attached to the plate only extends outward. With regard to the thickness of the reinforcement rings, the thickness of the reinforcement ring which is closer to the base is greater by a factor of up to 4, and the thickness of the second reinforcement ring, which lies further away from the base, is greater by a factor of up to 6, than the thickness of the adjoining metal casing, the axial extent of the first reinforcement ring being greater than or equal to that of the second. If the vessel is being used as a steel-casting ladle, the vessel edge is connected to a lid attachment, which is preferably frustoconical in cross section. The arrangement of a further reinforcement ring at the edge of the vessel is provided for in order to reinforce this area.

This known vessel, when subjected to combined load and heat stress, is stressed uniformly and is able to withstand being heated to a temperature of up to 400° C. A drawback of this design is that the weld joints between the reinforcement rings and the plate are exposed to high levels of load and the transition from the reinforcement ring to the plate is unfavorable in terms of its lines of force.

SUMMARY OF THE INVENTION

Starting from the known vessel, the object of the invention is to improve the design in such a way that the above-mentioned drawbacks are avoided and production of the vessel is simplified.

The essential novel modification to the design which is known per se relates to the design of the reinforcement rings in the area of the plate, which is designed as a shield segment. Both reinforcement rings have an extension in the form of a projection, one extension being directed upward and the other being directed downward. The shield segment is welded in between the two extensions. In this way, the connecting weld seams are placed in a zone which is subject to lower loads, so that the fatigue strength of this area is increased. Secondly, the transition from the reinforcement ring to the shield segment is highly rounded, this rounding continuing in the shield segment. This type of design improves the lines of force so that a virtually isotensoid design is produced. The particular shape and position of the two reinforcement rings, in conjunction with the shield segment, makes it possible to dispense with the reinforcement ring arranged on the vessel edge which is otherwise customary. Even in the case of vessels without an annular cover, the vessel is strong enough in the upper peripheral area for the arrangement of a boundary angle plate to be sufficient.

A further feature relates to the nature of the connection between the vessel bearing lug and the shield segment. In contrast to the known prior art, the bearing lug is not welded onto a plate, but rather is welded into a hole in the shield segment. In order also to relieve the load on these weld seams, the weld-in area of the vessel bearing lug is designed as a flange of larger diameter. To improve the quality of the weld seam, the periphery of the flange is of roof-like design, so that it can firstly be welded in from one side, then the root is turned out, and finally the mating bearing is welded on from the other side.

It has also proven advantageous if the reinforcement rings are composed of segments. This applies in particular to vessels which are oval in cross section. The individual segments of the reinforcement rings then have different radii, thus simplifying production of the reinforcement rings, in particular, in this way, making it possible to produce the area with the extension in the form of a projection separately. To achieve an optimum filling volume for the vessel, it is advantageous for the individual tube lengths to be of cylindrical design, as seen in longitudinal section.

The advantage of the vessel according to the invention lies in the fact that, firstly, there is no impermissible deformation even when it is heated to high temperatures, and the stress in the material of the vessel is distributed uniformly. A consequence of this is that the geometry of the vessel does not change even under high weight and temperature loads. This can be seen in particular from the fact that the bearing lugs remain horizontal. Furthermore, production is simplified, since it is possible to dispense with the reinforcement ring arranged on the vessel edge which is otherwise customary.

BRIEF DESCRIPTION OF THE DRAWINGS

The vessel for metallurgical purposes which is designed according to the invention is explained in more detail with reference to an exemplary embodiment illustrated in the drawing, in which.

DETAILED DESCRIPTION OF THE PREFERRED EMBODIMENTS

Figure 1:
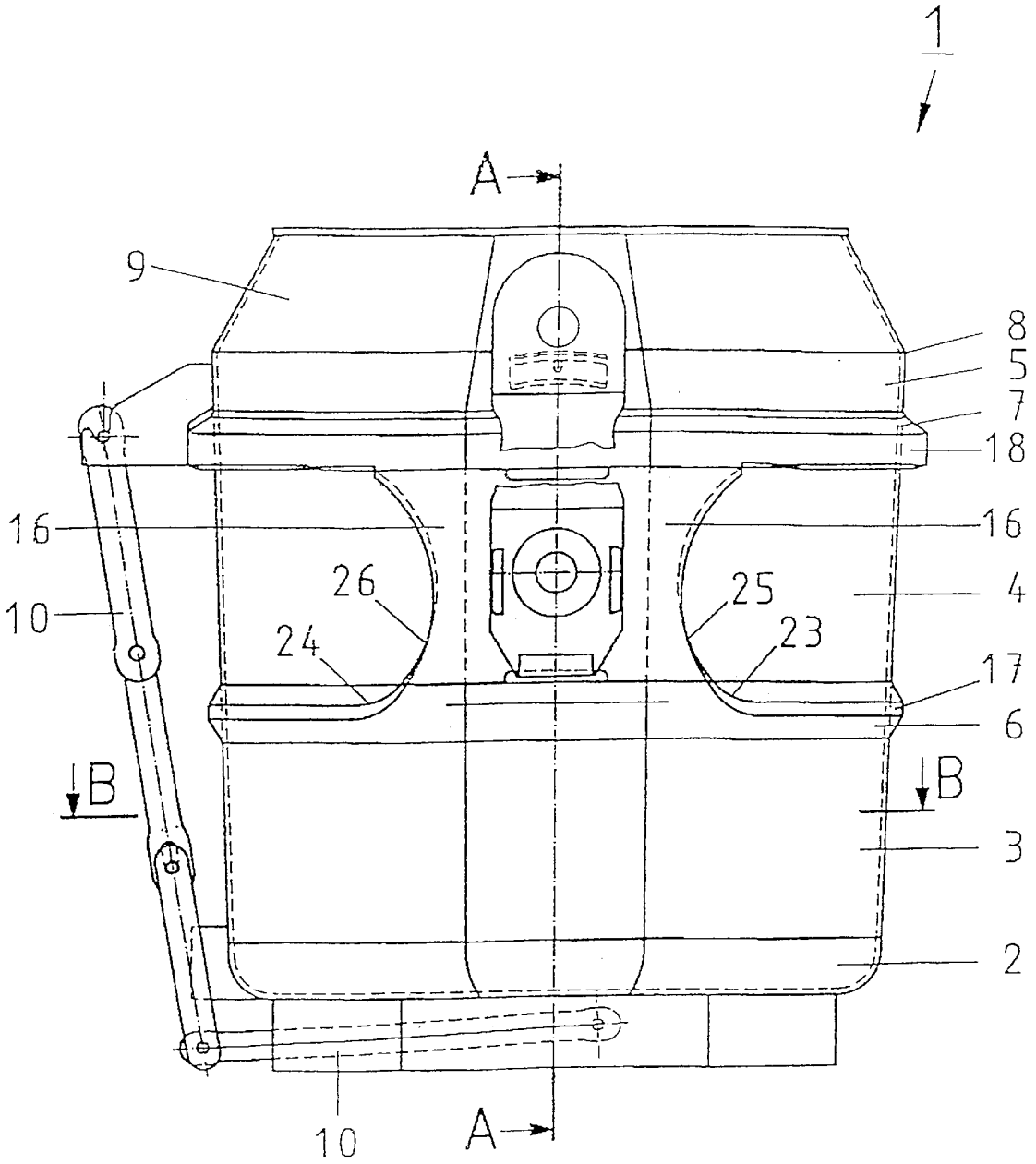
FIG. 1; shows a view of a vessel which is designed according to the invention.

FIG. 1 shows a view of a metallurgical vessel which is designed according to the invention and in this case is used, for example, as a steel-casting ladle 1. The steel-casting ladle 1 comprises a metal casing and a ladle base 2. In this exemplary embodiment, the metal casing is divided into three tube lengths 3–5 of different widths. Depending on the ladle height and design, the number of tube lengths may be smaller or greater. Two reinforcement rings 6, 7 are integrated in the metal casing between the tube lengths 3–5. In this exemplary embodiment, the upper edge 8 of the vessel is connected to a lid attachment, which is designed as an annular cover 9. Preferably, this annular cover 9 is frustoconical in cross section. A tiltable linkage 10 is arranged on the outside, in this case on the left, in order to be able to tilt the steel-casting ladle 1 by means of a crane (not shown here).

Figure 2:
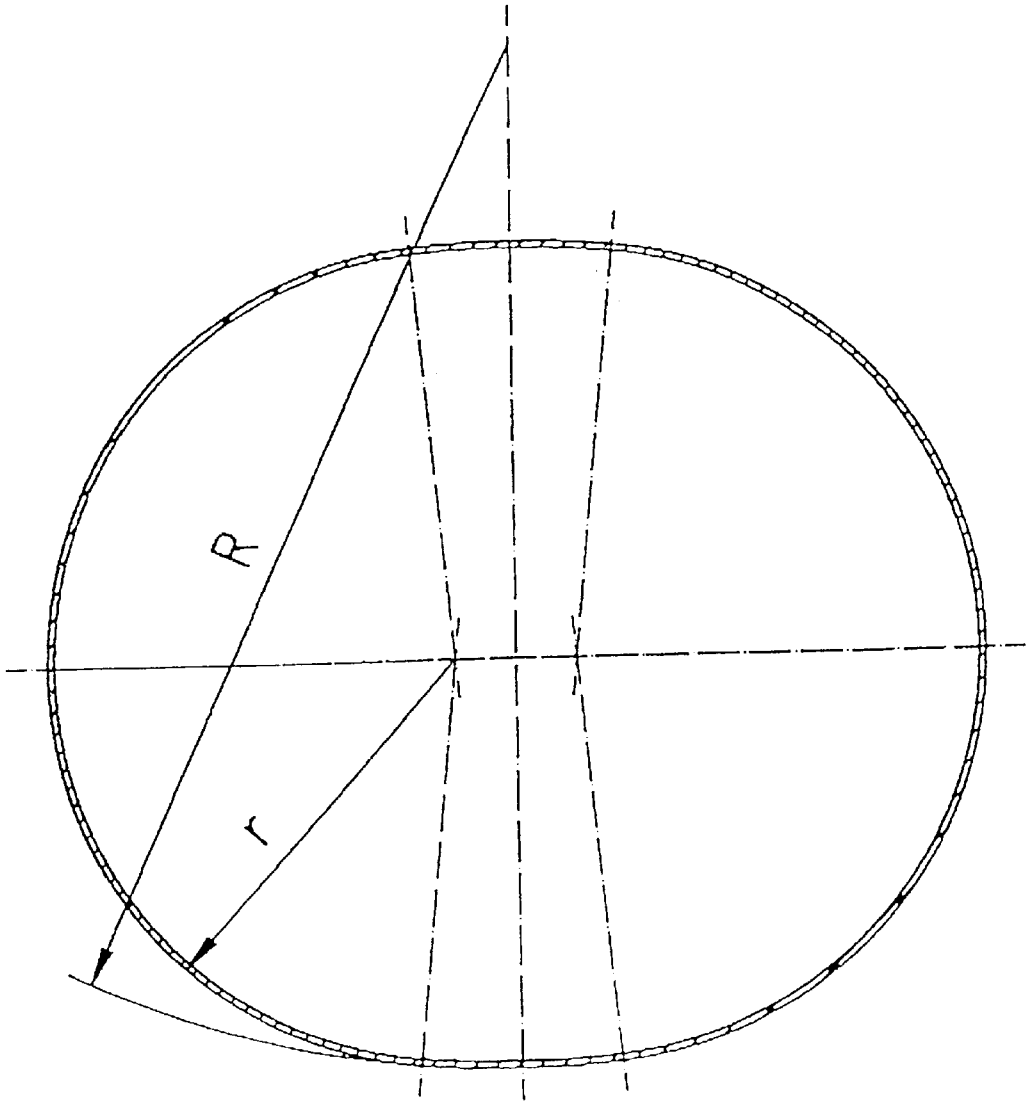
FIG. 2 shows a section on line B—B in FIG. 1.
Figure 3:
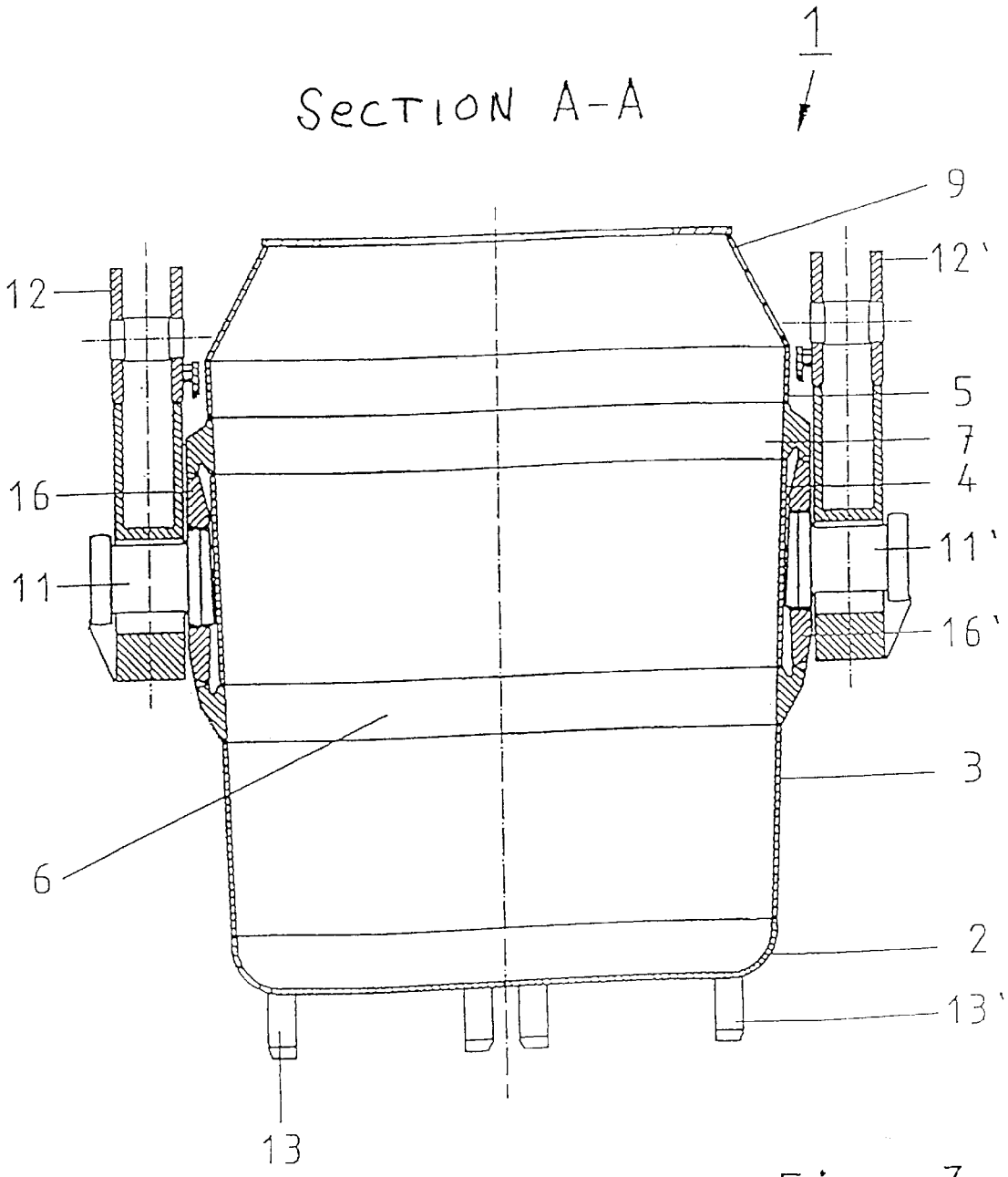
FIG. 3 shows a section on line A—A in FIG. 1

FIG. 2 shows a section in direction B-B in FIG. 1, illustrating the particular cross section of the steel-casting ladle 1 illustrated here. The cross section is elliptical, that area of the middle tube length 4 which lies behind the respective shield segment 16, 16' having a very large radius R for static reasons. For such a configuration, it is advantageous for the reinforcement rings 6, 7 to be composed of segments, the individual segments having different radii r, R. FIG. 3 shows a section in direction A—A in FIG. 1, illustrating the same steel-casting ladle 1 shown in FIG. 1. This representation provides a better illustration of the individual components of the steel-casting ladle 1. This includes the particular design of the reinforcement rings 6, 7 and the way in which the respective bearing lug 11, 11' is welded into the respective shield segment 16, 16'. The feet are denoted by 13, 13'.

Figure 4:
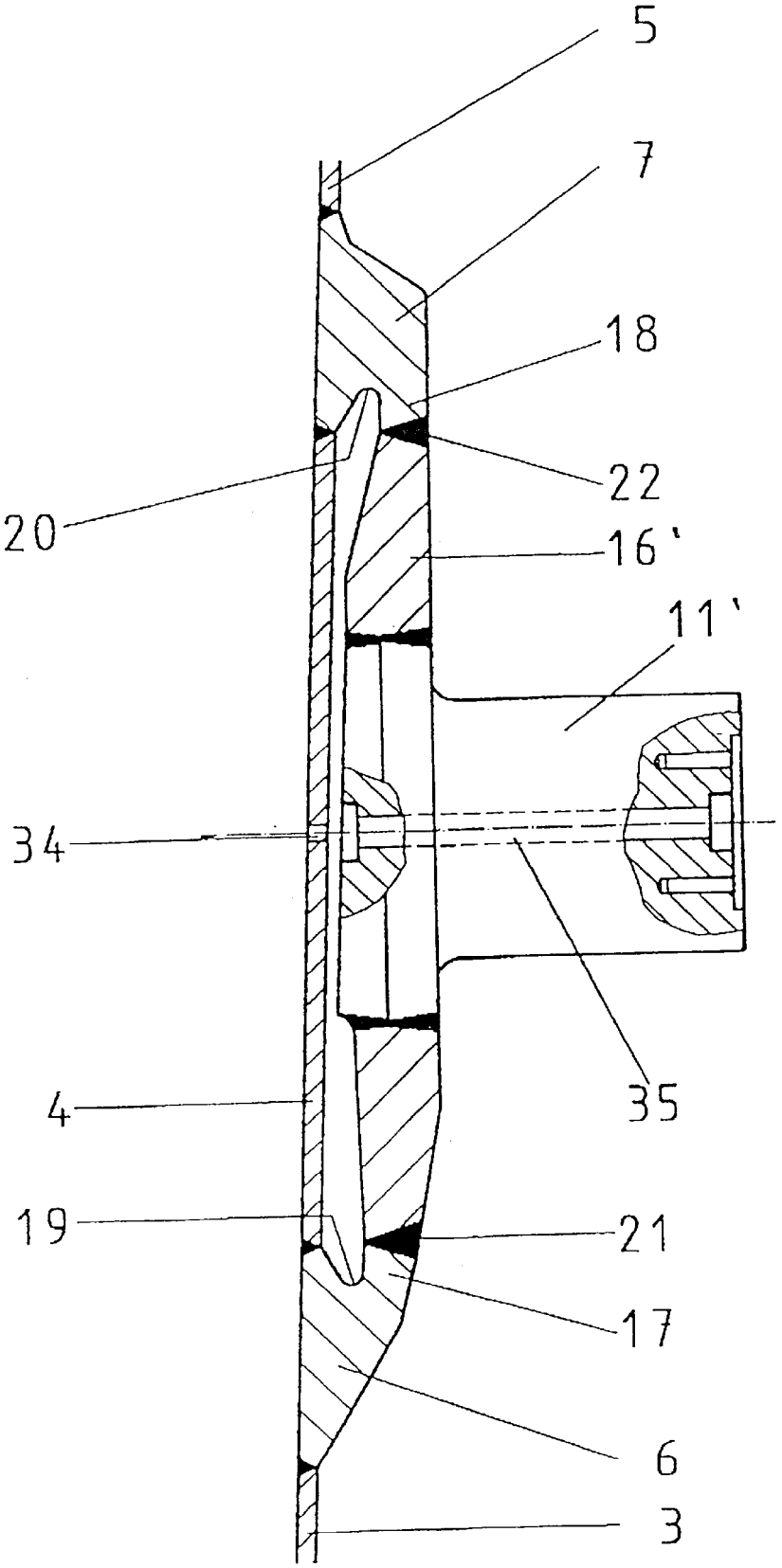
FIG. 4 shows the design of the bearing lug, including its joint with the shield segment, on an enlarged scale
Figure 5:
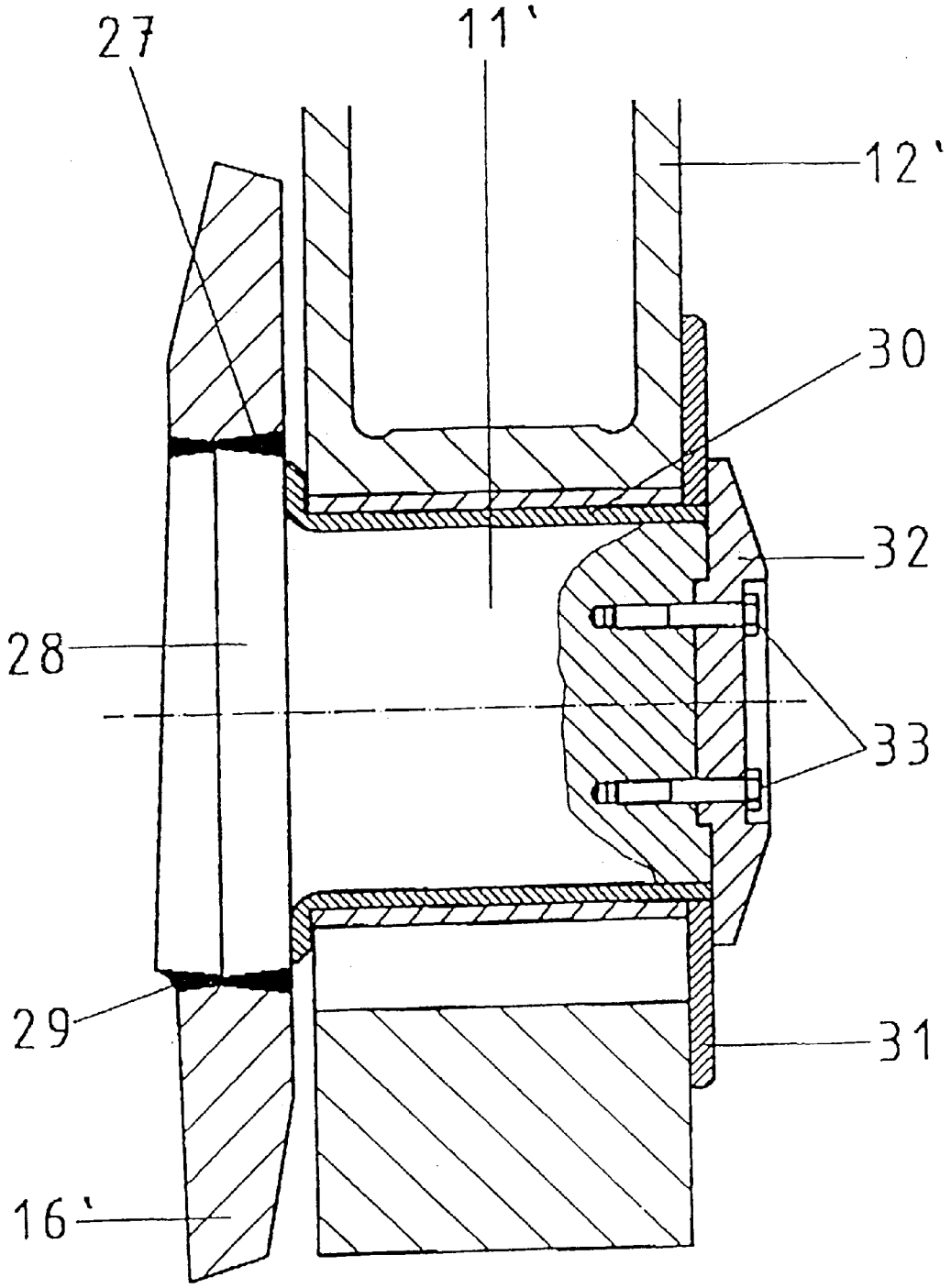
FIG. 5 shows the bearing lug on an enlarged scale.

That part of the steel-casting ladle 1 which is designed according to the invention is illustrated on an enlarged scale in FIG. 4. The one essential aspect relates to the extension 17, 18, in the form of a projection, of the respective reinforcement ring 6, 7, which extensions extend upward, in the case of the reinforcement ring 6 which lies closer to the ladle base 2, and downward in the case of the reinforcement ring 7 which lies further away from the ladle base 2. The transition from the respective extension 17, 18 into the actual reinforcement ring 6, 7, which transition can be seen in longitudinal section, is provided with a corresponding radius 19, 20. This type of design of the reinforcement rings 6, 7 in the area of the respective shield segment 16, 16' has allowed the connecting weld seams 21, 22 to be positioned in a zone which is subjected to lower loads. The second aspect relates to the rounded section 23, 24, which is horizontal in the view shown in FIG. 1, of the respective extension 17, 18, which rounded section 23, 24 carries on continuously into a corresponding rounded section 25, 26 of the shield segment 16.

The third aspect of the Invention relates to the way in which the respective bearing lug 11, 11' is welded into a hole 27 in the respective shield segment 16, 16'. Advantageously, for this purpose, that end area of the bearing lug 11' which faces toward the steel-casting ladle 1 is designed as a flange 28 of larger diameter. In order to achieve a high quality of weld seam, the periphery 29 of the flange 28 has a roof-like contour. As a result, it is possible firstly to provide one side with a weld seam, then to turn out the root of this first weld seam and then to weld on the mating bearing from the other side. In order to minimize the contact friction between the bearing lug 11' and the strap 12', the bearing lug 11' is provided with a bearing shell 30. A strip plate 31, which is fixed in place by means of a holding plate 32 attached to the end side of the bearing lug 11', forms the lateral support for the strap 12'. In this exemplary embodiment, the attachment is effected by means of screws 33.

In the production phase of the steel-casting ladle 1, the middle tube length 4 of the metal casing is provided with a small hole 34 (FIG. 4) which is aligned with a larger longitudinal hole 35 arranged in the respective bearing lug 11, 11'. A measuring device can be inserted into this longitudinal hole 35 in order to check that the two opposite bearing lugs 11, 11' are correctly aligned. After the measurement, the hole 34 in the metal casing is closed again.

What is claimed is:

1. A vessel for metallurgical purposes, for transporting molten metals, comprising:

a metal casing composed of individual tubular lengths and having a base and an upper edge;

two reinforcement rings which run in a circumferential direction and are integrated in the metal casing at an axial distance from one another, a first one of the rings being closer to the base of the casing and a second one of the rings being further away from the base;

two shield segments externally arranged on the reinforcement rings on opposite sides of the casing, each shield segment being at a short distance from the metal casing, the first reinforcement ring which lies closer to the base having a thickness greater by up to a factor of 4, and the second reinforcement ring which lies further away from the base having a thickness greater by a factor of 6 than a thickness of the metal casing, the first reinforcement ring having an axial extent at least equal to an axial extent of the second reinforcement ring;

two bearing lugs, a respective lug being mounted to each of the shield segments; and a lid attachment fastened to the upper edge of the casing, the lid attachment having a frustoconical cross section, the first reinforcement ring which lies closer to the base having an upward directed extension formed as a projection in a region of the shield segment, and the second reinforcement ring, which lies further away from the base, having a downwardly directed extension formed as a projection in the region of the shield segment, the shield segment being welded in between the extensions, a transition from a respective one of the extensions into a respective one of the reinforcement rings being rounded both in longitudinal section and in plan view, the rounded transition merging smoothly into corresponding rounded sections of the shield segment.

2. A vessel as defined in claim 1, wherein the shield segment has a hole, the bearing lug being welded into the hole in the shield segment.

3. A vessel as defined in claim 2, and further comprising a flange in an end region of the bearing lug which faces toward the shield segment, the flange having a larger diameter than the bearing lug.

4. A vessel as defined in claim 3, wherein the flange has a peripheral area with a peaked shape as seen in cross section.

5. A vessel as defined in claim 1, wherein the reinforcement rings are composed of individual segments.

6. A vessel as defined in claim 5, wherein the individual segments have different radii.

7. A vessel as defined in claim 1, wherein the tube lengths are cylindrical in longitudinal section.

8. A vessel as defined in claim 1, and further comprising a boundary angle plate welded onto a free end of an upper one of the tube lengths.

* * * * *